US006418748B1

(12) United States Patent
Kramer

(10) Patent No.: US 6,418,748 B1
(45) Date of Patent: Jul. 16, 2002

(54) MACHINERY COOLING SYSTEM

(75) Inventor: Matthew G. Kramer, Racine, WI (US)

(73) Assignee: Emmpak Foods, Inc., Butler, WI (US)

( * ) Notice: Subject to any disclaimer, the term of this patent is extended or adjusted under 35 U.S.C. 154(b) by 0 days.

(21) Appl. No.: 09/814,653

(22) Filed: Mar. 22, 2001

(51) Int. Cl.[7] ..... F25D 17/02
(52) U.S. Cl. ..... 62/434; 62/185
(58) Field of Search ..... 62/434, 430, 185, 62/62; 165/205, 80.2, 80.4

(56) References Cited

U.S. PATENT DOCUMENTS

| | | | | |
|---|---|---|---|---|
| 1,800,833 A | | 4/1931 | Huff | |
| 2,468,489 A | | 4/1949 | D'arcey | |
| 3,220,470 A | | 11/1965 | Balch | |
| 3,690,410 A | | 9/1972 | Sieghartner | |
| 3,805,880 A | | 4/1974 | Lawler | |
| 3,859,812 A | * | 1/1975 | Pavlak | 62/185 X |
| 4,095,644 A | | 6/1978 | Huff | |
| 4,220,015 A | | 9/1980 | Johansing, Jr. | |
| 4,368,775 A | | 1/1983 | Ward | |
| 4,458,747 A | | 7/1984 | Berry et al. | |
| 4,720,981 A | | 1/1988 | Helt et al. | |
| 4,729,424 A | | 3/1988 | Mizuno et al. | |
| 4,759,403 A | | 7/1988 | Flint et al. | |
| 4,945,978 A | | 8/1990 | Hermann | |
| 4,962,810 A | | 10/1990 | Bond et al. | |
| 4,987,953 A | | 1/1991 | Hedstrom | |
| 5,006,924 A | | 4/1991 | Frankeny et al. | |
| 5,022,494 A | | 6/1991 | Yamakage et al. | |
| 5,197,537 A | | 3/1993 | Chigira et al. | |
| 5,318,151 A | | 6/1994 | Hood et al. | |
| 5,727,393 A | | 3/1998 | Mahmoudzadeh | |
| 5,761,916 A | * | 6/1998 | Oswalt et al. | |
| 5,966,954 A | | 10/1999 | Arima et al. | |
| 6,003,319 A | * | 12/1999 | Gilley et al. | 62/430 X |
| 6,026,896 A | | 2/2000 | Hunter | |
| 6,161,612 A | | 12/2000 | St↑hl et al. | |
| 6,205,795 B1 | * | 3/2001 | Backman et al. | 62/434 |
| 6,234,240 B1 | * | 5/2001 | Cheon | 165/80.4 X |

FOREIGN PATENT DOCUMENTS

JP 10255136 A * 9/1998

* cited by examiner

*Primary Examiner*—Chen-Wen Jiang
(74) *Attorney, Agent, or Firm*—Lathrop & Clark LLP

(57) ABSTRACT

A closed loop cooling system for cooling machines, comprising a first heat exchanger having a refrigerant on a first side and a coolant on a second side and a coolant loop that circulates the coolant through the system; the coolant loop has a coolant supply header for circulating coolant flowing from the heat exchanger; a plurality of individual machine cooling loops connected to the coolant supply header, each machine cooling loop passing through at least one heat exchanger for cooling two or more fluids employed in an individual machine, and where each machine cooling loop has a flow meter and a regulating valve for adjustment of the coolant flow through the loop; and a coolant return header connected to the machine coolant loops for returning the coolant from the individual machine cooling loops to the first heat exchanger.

16 Claims, 1 Drawing Sheet

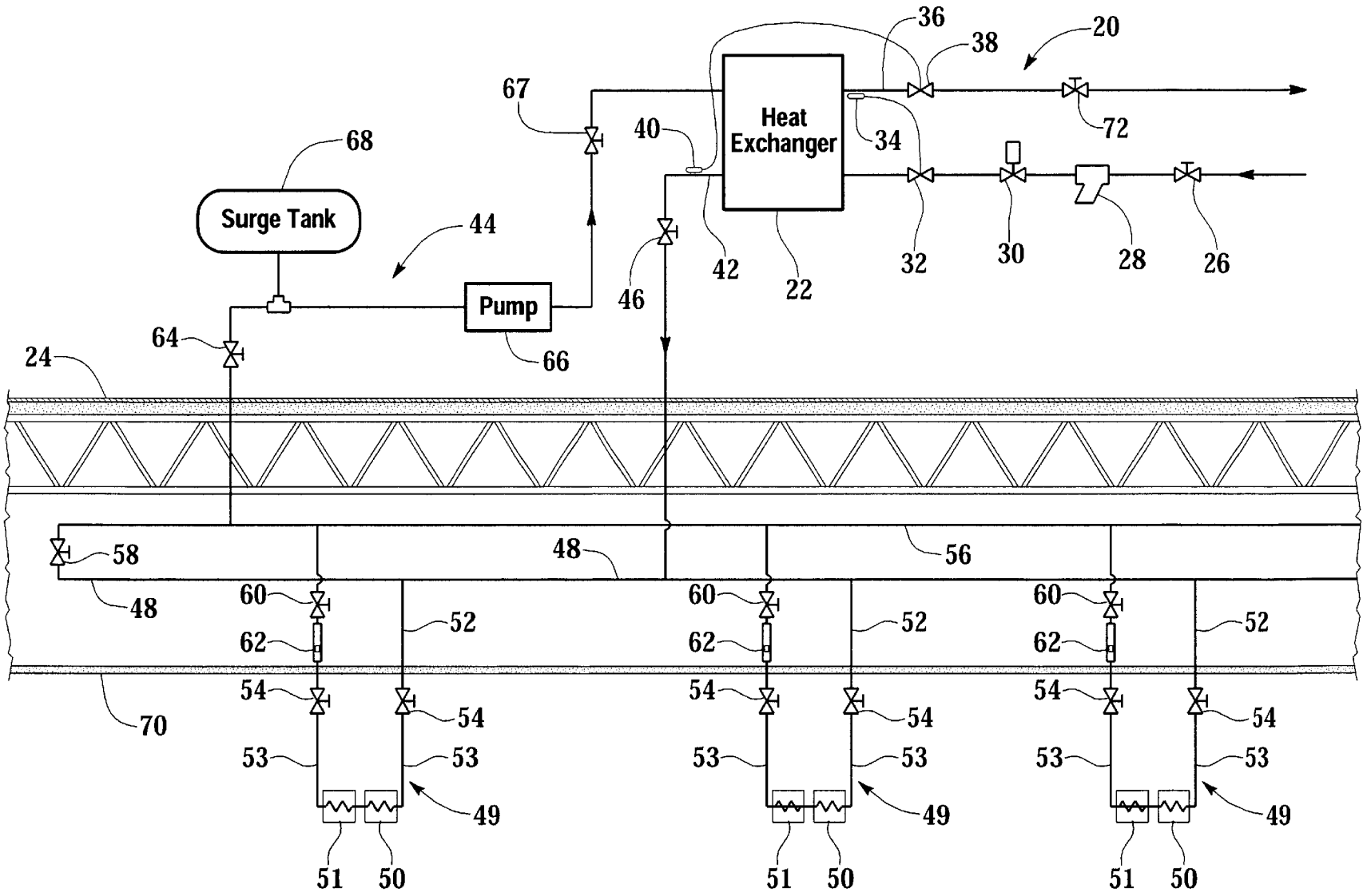
Heat Exchanger
Pump
Surge Tank
20
22
24
26
28
30
32
34
36
38
40
42
44
46
48
49
50
51
52
53
54
56
58
60
62
64
66
67
68
70
72

MACHINERY COOLING SYSTEM

BACKGROUND OF THE INVENTION

The present invention relates to refrigeration systems in general, and more particularly to refrigeration systems which provide cooling for air as well as machinery fluids.

Many industrial processes require control of the temperature of the material being processed and often of the machines handling the material. Particularly in the food industry an entire plant may be cooled to prevent spoilage and the growth of bacteria in foodstuffs. This is particularly a concern with meat, where it is important to control bacterial growth to assure product safety.

In an industrial setting, ammonia is oft en employed as a refrigerant. Ammonia is low cost and an efficient refrigerant for the temperature range of interest in many industrial processes. The hazards associated with ammonia: namely, flammability and toxicity if inhaled, are safely handled in an industrial setting where safety practices and monitoring equipment can be reliably employed. Thus, for industrial processes, ammonia is one of the most widely used refrigerants.

Ethylene glycol is a widely used coolant. When used alone or mixed with water it has excellent heat absorbing characteristics, good thermal conductivity, and remains liquid over a broad temperature band. Whereas ammonia is used in a refrigerator or heat pump to transport heat energy from a cool reservoir to a warm reservoir, ethylene glycol transports heat from a warm reservoir to a cool reservoir.

In industrial plants, merely keeping the air at a desired temperature will not typically ensure that a material being handled within the plant remains near the air temperature. Machines which perform work convert energy stored as hydraulic pressure into mechanical motion. Most of the energy, however, is eventually converted into heat. Where a material is worked by a machine, the machine and the material may become undesirably heated. For machines employing hydraulic fluid to transfer energy, a typical process is to cool the hydraulic oil used by individual machines by passing water through a heat exchanger so that heat from the oil is given up to the cooling water.

Ground water is sometimes used as a low cost source of cooling fluid to extract heat from hydraulic oil. Water has a high specific heat and when pumped from below the ground typically has a temperature, determined principally by latitude, which in the Midwest is typically in the neighborhood of 55 degrees Fahrenheit. In the past this ground water could be obtained at the cost of pumping it from the ground.

Modern industrial plants, particularly those handling organic material, are typically connected to their own or to a municipal sewage treatment plant. Particularly when connected to a municipal sewage treatment plant, the cost of treatment is based on the amount of water consumed. Thus the use of an open loop water cooling system can have considerable negative economic consequences.

To address this problem, a closed loop cooling system was developed. In this system, which is set forth in pending U.S. patent application Ser. No. 09/443,604, filed Nov. 19, 1999, the disclosure of which is incorporated by reference herein, refrigerant used in providing air conditioning to a plant is also used to remove heat from a coolant, typically ethylene glycol, by use of a first heat exchanger. The coolant is circulated through via a supply header to a plurality of individual machine cooling loops, where it passes through a heat exchanger to cool machine hydraulic fluid. After passing through the individual heat exchanger for each machine, the coolant fluid from the individual machine cooling loops passes into a fluid return header, from where it is pumped to the first heat exchanger for the cycle to begin again.

While this system is very efficient, it fails to address undesirable machine heating that may occur with respect to machine fluids other than hydraulic fluid. For example, many machines, in addition to hydraulic systems, also involve gears to transfer energy. Such gears, which are usually contained in a gear box on the machine, are lubricated by gear oil to reduce heat and friction. Such lubrication is desirable, because both heat and friction adversely affect the gears, and significantly reduce their useful life.

As machines are operated at higher speeds, the gears move at a faster rate, thus generating increased amounts of friction and heat. This, in turn, results in the temperature of the gear lubricating oil rising to undesirably high levels, which if maintained over time will result in accelerated wearing of the gears themselves. To prevent high gear oil temperatures from occurring, the simple solution is to operate the machines at a reduced speed such that the gear oil temperature remains within a specified recommended range. However, this solution results in decreased machine efficiency and productivity.

Accordingly, there is a need to keep additional machine fluids besides hydraulic fluid within a temperature range sufficient to avoid excess wear and tear to machine components, such as gears. There is also a need to maintain such fluids within such a temperature range even when the machine is operating at high rates of speed. Moreover, there is a need to accomplish the above in an efficient and effective manner.

SUMMARY OF THE INVENTION

The cooling system of this invention employs a coolant transport loop which is cooled by the existing plant ammonia-based air conditioning or other refrigeration system. The coolant loop, which employs a liquid coolant, moves through an ammonia evaporator where the coolant is lowered to a set point temperature, typically around 50 degrees Fahrenheit. The coolant then flows to a supply header.

The supply header is connected to a return side header by one or more individual machine cooling loops which pass through one or more associated heat exchangers mounted on individual machines for cooling the fluids employed by each machine, including hydraulic fluid and gear oil. In this regard, a single combination-type heat exchanger capable of cooling two or more separate fluids can be used for each individual cooling loop. Multiple heat exchangers, one for each fluid, can also be used, and can be aligned in series or in parallel. The return header is connected through an isolation valve to a surge tank and to a pump that returns the fluid to the ammonia heat exchangers where the coolant, typically ethylene glycol or an ethylene glycol/water solution, is again cooled and sent to the supply header.

It is an object of the present invention to provide a lower cost method of cooling industrial machinery.

It is a further object of the present invention to provide a method of regulating the cooling of a plurality of machines without introducing ammonia into the factory floor.

It is a still further object of the present invention to eliminate open loop cooling within a manufacturing facility handling foodstuffs.

It is yet an additional object of the present invention to provide an efficient and effective system for cooling at least two machine fluids in a given machine.

It is another object of the present invention to provide a system for extending the life of machine parts serviced by such fluids.

Further objects, features and advantages of the invention will be apparent from the following detailed description when taken in conjunction with the accompanying drawings.

BRIEF DESCRIPTION OF THE DRAWINGS

The FIGURE is a schematic view of the machinery cooling system of this invention.

DESCRIPTION OF THE PREFERRED EMBODIMENTS

Referring more particularly to the FIGURE, wherein like numbers refer to similar parts, an ammonia cooling loop 20 which passes through a heat exchanger 22 is shown. The heat exchanger 22 is an Alfa Laval M6-MWFDR model plate and frame heat exchanger available from Alfa Laval. The ammonia cooling loop 20 includes a compressor (not shown) followed by a heat exchanger (not shown) which are typically mounted on a factory roof 24 where atmospheric air is used to remove heat and condense the ammonia.

As is well understood in the art of refrigeration, a refrigerant such as ammonia, which has a low boiling point temperature and a large heat of evaporation, is allowed to absorb heat in a heat exchanger by being allowed to boil at a low pressure. A compressor, by raising the pressure of the refrigerant vapor, allows the vapor to be condensed at a higher temperature.

Thus ammonia returning from the high temperature heat exchangers (not shown), passes through an isolation valve 26, a strainer 28, a RS S8F one-half inch solenoid valve 30, and a Sporlan DEA 15L one-half inch thermal/expansion valve 32. The expansion valve 32 controls the rate at which ammonia flows into the heat exchanger 22 and the valve position is controlled by a temperature sensor 34 on the compressor side 36 of the ammonia loop 20 upstream of a RS A4AT one and one-quarter inch suction regulating valve 38.

The suction regulating valve 38 is controlled by a temperature sensor 40 positioned on the output side 42 of a cooling loop 44 containing a liquid coolant which passes through the heat exchanger 22 and is cooled by the evaporating ammonia. Any known liquid coolant or combination of coolants may be used, with the use of ethylene glycol or ethylene glycol/water solutions being preferred. The suction regulating valve 38 controls the pressure at which ammonia is caused to boil in the heat exchanger 22. The valve 38 is typically set to maintain the coolant at a temperature sufficient to cool the machine fluids subjected to heat exchange with the coolant in the later described individual machine cooling loops to a desired temperature. Normally, the coolant temperature as it leaves the heat exchanger 22 should be approximately 50° F., although it can be higher or lower as desired. The valve 38 may require factory porting for the smaller load of a particular system.

The ammonia cooling loop 20 will typically be part of a larger cooling system with the ammonia compressor drawing ammonia vapor from a number of low temperature ammonia evaporators/heat exchangers, and the condenser/high temperature heat exchanger supplying liquid ammonia to those same ammonia evaporators. Thus in a typical meat processing facility the majority of the refrigeration capability will be used to chill factory air, and provide refrigeration for freezing and storing product.

Ammonia, because of its toxicity and flammability, requires a process safety management program tailored to deal with the particular hazards associated with ammonia. Typically cost is minimized and safety maximized by isolating ammonia within selected portions of a factory where heightened safety management to respond specifically to the hazards of ammonia are installed. Other portions of the factory which are isolated from the ammonia handling equipment can thus be more cost effectively designed and maintained. Typically ammonia will be limited to a heat exchanger located on the roof of a factory and within the factory engine room where the ammonia compressor may be located.

The coolant loop 44, after leaving the ammonia heat exchanger 22, passes through an isolation valve 46 to a coolant supply header 48, which is preferably one and one-half inch copper tubing. Coolant from the supply header 48 is then supplied to individual machine cooling loops 49, through which the fluids in individual machines, such as hydraulic fluid and gear oil, are cooled. Typical machines where this type of cooling is necessary are Formax® pattie forming machines such as are available from Formax, Inc. of Mokena, Ill. Formax® pattie forming machines utilize both hydraulic fluid and gear oil. The cooling loop system described herein is sized for a facility employing seven F-26 Formax® pattie forming machines, but could be sized for any number or type of machines.

In the individual machine cooling loops 49, coolant is supplied to one or more heat exchangers through one-half inch copper supply lines 52 which drop through the factory floor false ceiling 70 and are connected by flexible hoses 53 to the heat exchanger or heat exchangers. While the FIGURE illustrates the use of two heat exchangers 50 and 51 in series, with a first heat exchanger 50 being used to cool a first machine fluid and a second heat exchanger 51 being used to cool a second machine fluid, it should be emphasized that the present invention is not so limited. The present invention contemplates (1) the use of a single combination heat exchanger, where one coolant fluid cools two or more machine fluids, (2) the use of two or more heat exchangers in series, (3) the use of two or more heat exchangers in parallel, or (4) any combination of the above.

For a system where two machine fluids, such as hydraulic fluid and gear oil, are to be cooled, it is preferred that two heat exchangers 50 and 51 aligned in series be used, with the coolant first flowing through a first heat exchanger 50 to cool the hydraulic fluid, and then passing from the first heat exchanger 50 to second heat exchanger 51 to cool the gear oil. Of course, the gear oil could be cooled in the first heat exchanger, and the hydraulic fluid be cooled in the second heat exchanger, if so desired. For example, in the above-described system involving seven Formax® pattie forming machines, ethylene glycol coolant at approximately 50° F. enters the first heat exchanger 50 in an individual machine cooling loop 49, and cools the hydraulic fluid passing through that heat exchanger. The ethylene glycol exits the first heat exchanger 50 at a temperature of approximately 60° F., and flows into a second heat exchanger 51, where it cools gear oil from the machine's gear box. In this way, the gear oil can be kept at a temperature of approximately 120° F. in the gear box, even when the Formax® pattie forming machines are being operated at extremely high rates of speed. In contrast, if the gear oil is not cooled, it can reach a temperature in the gear box in the range of 190–210° F., which significantly reduces gear life. Any appropriately sized heat exchanger may be used, for example the Model AB-702-A4-FP, with a flow of about 2 gallons per minute, available from American Industrial Heat Transfer Inc., of Zion, Ill.

Each individual machine coolant loop 49 employs two isolation valves 54 so a particular machine can be isolated from the coolant supply header 48 and return header 56. Such isolation is useful when a machine is installed, removed, or shut down.

The return header 56 is also fabricated of one and one-half inch copper pipe. Resistance to fluid flow scales as the fourth power of pipe diameter, so that headers 48 and 56 (which are three times the diameter of the supply lines 52 to individual machines) have insignificant pressure drops by comparison to the pressure drop in the supply lines 52.

Preferably, a regulation valve 58 connects the supply header 48 directly to the return header 56 for the purpose of maintaining a constant pressure drop between the supply header 48 and the return header 56. Where the total pressure drop for the system of the FIGURE is approximately 42 psi, the pressure drop between the supply header and the return header constitutes a substantial portion of the total pressure drop. To maintain a constant pressure drop the regulation valve 58 must be self-adjusting or adjustable in response to a controller so as to maintain the pressure drop across the valve 58. The effect of the regulation valve 58 is to make the coolant flow through each individual machine coolant loop 49 essentially independent of the coolant flow through every other individual machine cooling loop 49.

Without the regulating valve 58 between the supply header 48 and the return header 56, a change in the flow of coolant through a single individual machine cooling loop 49 would require the iterative adjustment of all flow valves in the coolant circuit. Such adjustment could be accomplished through the use of a controller (not shown) in electrical contact with a sensor 62, such as a flow meter, and valves 54 in each individual machine cooling loop 49. While such a system may be more complex than that involving the use of a regulating valve 58, it is still within the scope of the present invention. With the employment of the regulating valve 58 between the supply header 48 and the return header 56, the coolant flow through the individual machine cooling loops 49 can be adjusted by adjusting a single regulation valve 60 based on a sensor such as a flow meter 62 responsive to the fluid flow through a particular set of supply lines 52.

The return header 56 is connected through an isolation valve 64 to a pump 66 and a surge and expansion tank 68. The surge tank serves to minimize pressure spikes in the coolant loop 44 and to adjust coolant supply as machines are added or removed from the coolant loop 44 and absorb expansion of the cooling solution when the system is shut down and fluid volume increases due to temperature increase of the coolant. For the system described, a 30 gallon expansion tank is sufficient. From the pump 66 the coolant flows through a check valve 67 to the heat exchanger 22.

The pump 66 is sized to meet the requirements set by the number of machines cooled and the total resistance to fluid flow of the various fluid loops. A pump from the Goulds Series 3642, of two horsepower which supplies 40 gallons per minute at a pressure equivalent to a head of ninety feet is employed in the coolant loop 44. Such a pump is available from Goulds Pumps, Incorporated (Seneca Falls, N.Y.).

When the system is within the range of maximum cooling capability it is self-adjusting. As machines transfer heat to the coolant in the individual machine cooling loops 49, the temperature of the coolant flowing into the heat exchanger 22 increases. The coolant output temperature is regulated to the desired temperature, such as for example, approximately 50° F., by opening the suction valve 38 to increase the rate at which ammonia is evaporated in the heat exchanger 22. Opening the suction valve 38 allows more ammonia to be evaporated, removing more heat from the coolant. If insufficient ammonia is supplied to the heat exchanger 22, the temperature of the ammonia vapor leaving the heat exchanger 22 increases, which causes the expansion valve 32 to increase the flow of ammonia to the heat exchanger 22.

An isolation valve 72 is positioned between the suction valve 38 and the ammonia compressor (not shown). It should be understood that expansion valves, suction valves, solenoid shut off valves, and isolation valves can be obtained from companies such as Porlan Valve Company (St. Louis, Mo.).

It should also be understood that ammonia is a refrigerant. Other widely used refrigerants include hydrocarbons and fluorocarbons and compounds containing chlorine, fluorine, carbon and hydrogen, the particular compounds being well known to those skilled in the art. Similarly, coolant fluids other than ethylene glycol and ethylene glycol/water are known to those skilled in the art, and can be used in the practice of the present invention.

It is understood that the invention is not limited to the particular construction and arrangement of parts herein illustrated and described, but embraces all such modified forms thereof as come within the scope of the following claims.

I claim:

1. A closed loop cooling system for cooling machines, comprising:

a first heat exchanger having a refrigerant on a first side and a coolant on a second side;

a coolant loop that circulates the coolant through the system; the coolant loop comprising:

a coolant supply header for circulating coolant flowing from the heat exchanger;

a plurality of individual machine cooling loops connected to the coolant supply header, each machine cooling loop passing through at least one heat exchanger for cooling two or more fluids employed in an individual machine, and where each machine cooling loop has a flow meter and a regulating valve for adjustment of the coolant flow through the loop; and a coolant return header connected to the machine cooling loops for returning the coolant from the individual machine cooling loops to the first heat exchanger.

2. The system of claim 1, wherein each individual machine cooling loop contains at least two heat exchangers, and where the heat exchangers in each individual machine cooling loop are connected in series.

3. The system of claim 1, wherein each individual machine cooling loop contains two heat exchangers, one heat exchanger for cooling hydraulic fluid, and the other heat exchanger for cooling gear oil.

4. The system of claim 3, wherein the heat exchangers are connected in series.

5. The system of claim 3, wherein the refrigerant is ammonia, and the coolant comprises ethylene glycol.

6. The system of claim 1, wherein the individual machines are of the type used to manufacture meat-based products.

7. The system of claim 6, wherein the individual machines are of the type used to manufacture meat patties.

8. The system of claim 1, wherein the refrigerant is ammonia, and the coolant comprises ethylene glycol.

9. The system of claim 1, further comprising a valve connected between the coolant supply header and the coolant return header for maintaining a constant pressure drop between the supply header and the return header.

10. The system of claim 9, wherein the valve between the coolant supply header and the coolant return header is automatically regulated to maintain a constant pressure drop.

11. A closed loop cooling system for cooling machines used in manufacturing meat-based products, comprising:

a first heat exchanger having a refrigerant on a first side and a coolant on a second side; and a coolant loop that circulates the coolant through the system; the coolant loop comprising:

a coolant supply header for circulating coolant flowing from the heat exchanger;

a plurality of individual machine cooling loops connected to the coolant supply header, each machine cooling loop passing through at least two heat exchangers connected in series for cooling two or more fluids employed in an individual machine, and wherein each machine cooling loop has a flow meter and a regulating valve for adjustment of the coolant flow through the loop; and a coolant return header connected to the machine coolant loops for returning the coolant from the individual machine cooling loops to the first heat exchanger.

12. The system of claim 11, wherein each individual machine cooling loop contains two heat exchangers, one heat exchanger for cooling hydraulic fluid, and the other heat exchanger for cooling gear oil.

13. The system of claim 11 wherein the individual machines used to manufacture meat-based products are of the type used to manufacture patties.

14. The system of claim 11, wherein the refrigerant is ammonia, and the coolant comprises ethylene glycol.

15. The system of claim 11, further comprising a valve connected between the coolant supply header and the coolant return header for maintaining a constant pressure drop between the supply header and the return header.

16. The system of claim 15, wherein the valve between the coolant supply header and the coolant return header is automatically regulated to maintain a constant pressure drop.

* * * * *